US006056132A

United States Patent [19]

Becker et al.

[11] Patent Number: 6,056,132

[45] Date of Patent: May 2, 2000

[54] MAGNETIZABLE PARTS HOLDER

[76] Inventors: Bryan Robert Becker, 1712 Vegas Valley Dr., Las Vegas, Nev. 89109; Sean M. Murray, 1147 S. Ocean Dr., Ft. Pierce, Fla. 34949

[21] Appl. No.: 09/173,520

[22] Filed: Oct. 15, 1998

[51] Int. Cl.[7] ..... A47F 5/02; G09F 3/18

[52] U.S. Cl. ..... 211/164; 40/661.01

[58] Field of Search ..... 211/163, 164, 211/DIG. 1; 40/661.01, 503, 493, 494, 621, 600

[56] References Cited

U.S. PATENT DOCUMENTS

| | | | |
|---|---|---|---|
| 475,120 | 5/1892 | Klingenberg | 211/163 X |
| 770,756 | 9/1904 | Hynek | 211/163 X |
| 846,133 | 3/1907 | McIntyre | 211/164 X |
| 2,936,901 | 5/1960 | Siemantel | 211/164 X |
| 3,704,777 | 12/1972 | Linnedehr . | |
| 3,776,387 | 12/1973 | Brent | 211/DIG. 1 X |
| 3,782,799 | 1/1974 | Hansen | 211/DIG. 1 X |
| 3,831,743 | 8/1974 | Leedy . | |
| 3,997,050 | 12/1976 | Patterson | 211/163 X |
| 4,040,194 | 8/1977 | Penton et al. | 40/621 |
| 4,712,693 | 12/1987 | Striplin | 211/164 |
| 5,052,563 | 10/1991 | Camp | 211/163 X |
| 5,176,263 | 1/1993 | Caruso | 211/163 X |
| 5,228,582 | 7/1993 | Marshall et al. | 211/163 |
| 5,405,004 | 4/1995 | Vest et al. . | |
| 5,531,332 | 7/1996 | Monnens | 211/164 X |
| 5,760,668 | 6/1998 | Testa et al. | 211/DIG. 1 X |

*Primary Examiner*—Daniel P. Stodola
*Assistant Examiner*—Erica B. Harris
*Attorney, Agent, or Firm*—McHale & Slavin

[57] ABSTRACT

A device for holding magnetizable articles includes a revolving drum having externally-mounted magnets. Part-identification labeling surfaces are also included on the drum exterior. In a preferred embodiment, the drum is oriented horizontally and is supported by a contoured base. The drum is seated within side supports of the base, and adjustable knobs provide varied amounts of relative friction between the drum and the base. The drum is removable even if fully-loaded and may be replaced with a secondary drum. In another embodiment, the revolving apparatus is mounted vertically, allowing several drums to be used simultaneously.

9 Claims, 2 Drawing Sheets

MAGNETIZABLE PARTS HOLDER

FIELD OF THE INVENTION

This invention relates to devices that organize magnetizable objects, and more particularly, to a rotatable drum that stores magnetizable objects during repair, disassembly, or reassembly projects.

BACKGROUND OF THE INVENTION

Presently, when disassembling items that contain fasteners, including screws, nuts, or bolts, and washers or any parts that require removal and temporary storage, it is time consuming and cumbersome to place, label, and when the time comes for reassembly, locate the correct part for the stage of reassembly at hand.

Some devices have been developed to help with this task. For example, the Tool and Parts Tray in U.S. Pat. No. 5,405,004 issued to Vest et al., Apr. 11, 1995, is primarily designed and described for use in the repair of a motor vehicle. As a result, the Vest device is limited to storing any magnetizable parts and/or tools in a large general chamber. Although the Vest device includes a magnet, the Vest device provides little assistance for organizing and labeling specific parts.

The Selectable Multi-Compartment Magnetic Dispenser in U.S. Pat. No. 3,831,743, issued to Robert M. Leedy, Aug. 27, 1974, separates similar articles into different chambers. However, the Leedy device is primarily a container that dispenses like articles from various compartments. Leedy is not intended for use as a workstation device, but rather as a storage dispenser device, capable of holding large quantities of similar articles in an enclosed chamber.

As with the Leedy device, the Container For Magnetizable Articles in U.S. Pat. No. 3,704,777, issued to Linnedehr, Dec. 5, 1972, is a primarily a dispenser. Although Linnedehr uses magnetism to hold articles, the stored items are held inside a chamber rather than mounted on the device exterior.

What is needed is a device that incorporates the features of the known devices, while overcoming the shortcomings they exhibit. The device should be rotatable to allow access to all items sorted, as desired. The device should also include magnets to store magnetizable items for easy retrieval. The device should also include a variable drag feature to selectively alter the ease with which the device rotates.

SUMMARY OF THE INVENTION

The present invention is a storage and organizing device for magnetizable items. The device includes a rotatable drum mounted on a support construction. Magnets are disposed on the exterior of the drum, allowing magnetizable items to be selectively secured onto the outside of the drum. Adjustable knobs extend from the drum to engage the support construction; adjusting the knobs changes the relative friction between the drum and the support construction. The knobs may be used to lock the drum in place or to allow free rotation of the drum. The floor of the support construction includes upstanding walls and acts as a collection tray for items that are not stored on the drum. The drum also includes tape portions on which identification marks may be placed.

This device is a time-saving, space-saving, lightweight apparatus for use primarily in a work station where magnetizable parts are maintained in an orderly fashion on the exterior of a rotatable drum. This device also promotes accurate retrieval of items that are similar, but not identical.

Thus, it is an object of the present invention to provide a dispenser for magnetizable articles.

An additional object of the present invention is to provide a storage device having an exterior that accepts magnetizable parts in any number of user-selected arrangements.

Still another object of the present invention is to provide a storage device with provisions to temporarily index or label stored parts.

A further object of the present invention is to provide a storage device that is compact, yet makes efficient use of work space to store large numbers of items.

Yet an additional object of the present invention is to provide a device that allows quick storage of small items for extended periods of time, yet allows quick retrieval.

Still a further object of the present invention is to provide a storage device that is modular, having components that may be removed while fully-loaded and replaced so that one support construction may be used with several collections of parts.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
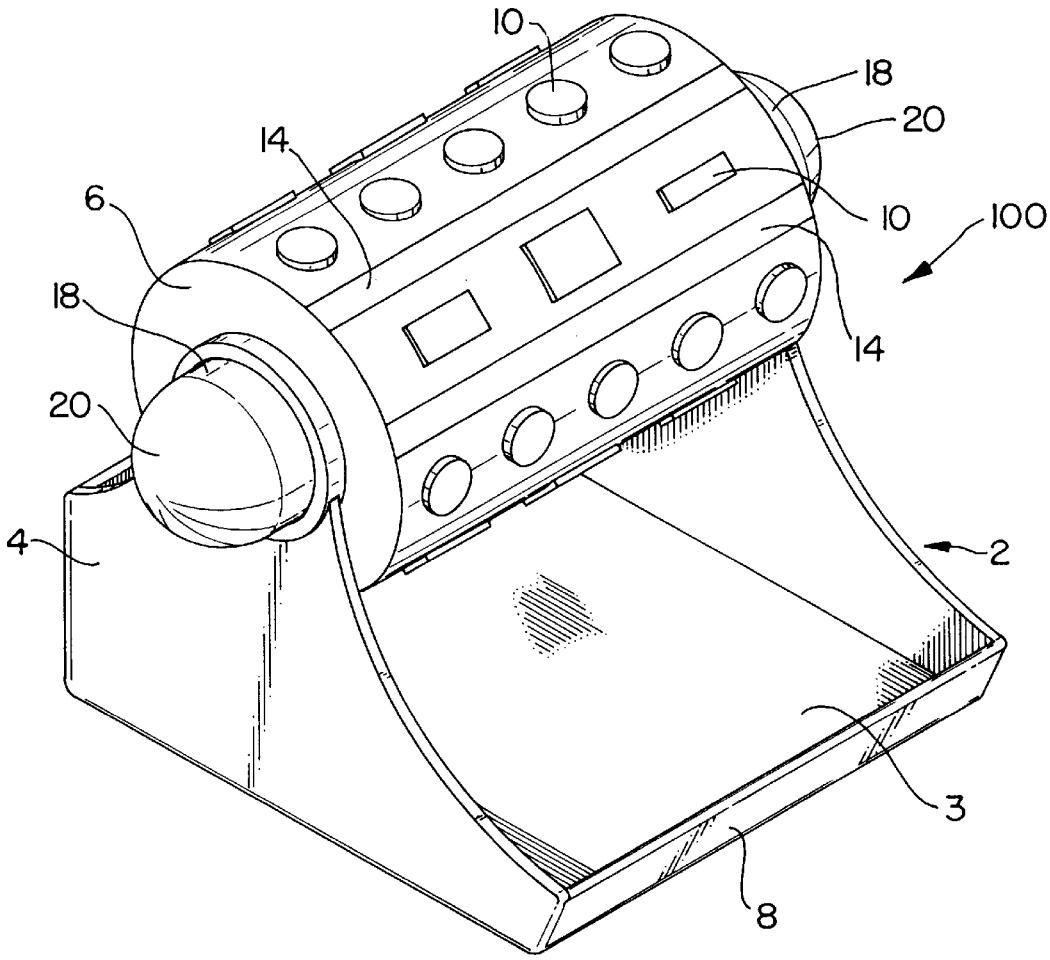
FIG. 1 is a top view of the storage device of the present invention.

Now with reference to FIG. 1, the storage device 100 of the present invention is shown. The device 100 includes a rotatable drum 6 mounted on supports 4 that extend up from a floor panel 3. The base 2 also includes front and back walls 8,12 of sufficient height to retain parts that are either not magnetizable or otherwise not to be stored on the drum 6.

Figure 2:
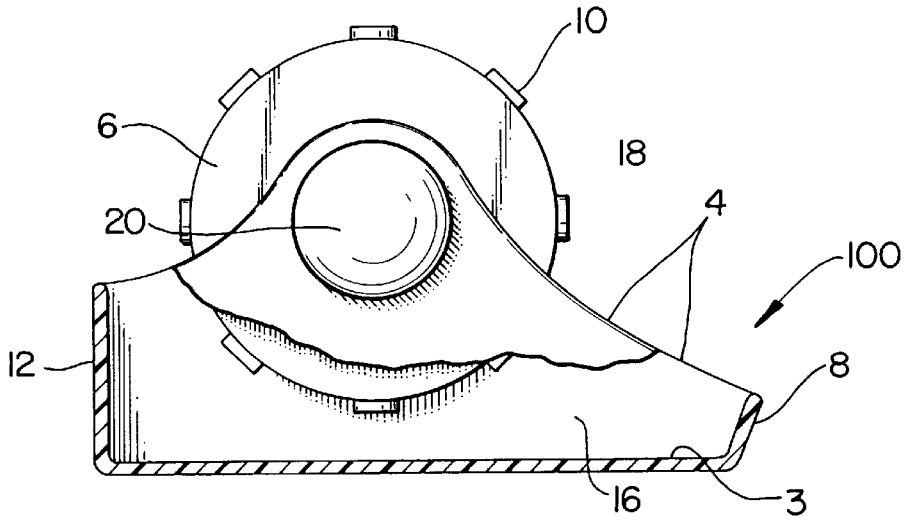
FIG. 2 is a side view of the storage device showing FIG. 1, having a partially cut-away side wall.

As shown in FIG. 2, the front wall 8 of the base 2 is preferably low to provide front access to parts placed onto the base. The back wall 12 is higher. The support sides 4 slope up gradually from the front to give more clearance between the front wall 8 and the drum 6.

The outer surface of the drum 6 is characterized by rows of magnets 10 that span the width of the drum 6. In keeping with the organization-promoting objects of the present invention, the drum 6 also includes customizable strips 14 that may be labeled as desired. In a preferred embodiment, the strips include adhesive to accept part-identifying indicia. The strips 14 may also include markable surfaces, such as chalkboard or paper, onto which notes may be made directly. In a preferred embodiment, the supports 4 may be resiliently flexed apart to allow insertion of knobs 20 into mounts 18. More specifically, the drum is "snapped" into place within the mounts 18; the mounts are actually passthrough apertures that perforate the supports 4. The mounts 18 may alternatively be contoured cutouts onto which the drum may be rested.

In keeping with the adjustable nature of the present invention, the knobs 20 threadably engage the central axis of the drum 6. As a result, the knobs 20 may be adjusted to vary the amount of force required to rotate the drum 6 within the mounts 18. Specifically, as the knobs 20 are threaded towards the middle of the drum 6, the knobs begin to bind against the supports 4, thereby increasing the friction required to move the drum. Backing the knobs 20 out from the middle of the drum 6 permits the drum to rotate more freely. This adjustable drag feature advantageously allows the drum 6 to be selectively locked in place, preventing heavy objects from "bottoming out," forcing the drum into an unwanted orientation. This locking feature capability is especially helpful when only one or two rows of magnets 10 are occupied.

In the preferred embodiment, the magnets 10 are glued or otherwise affixed permanently to the drum 6. However, the magnets 10 may also be attached in other ways. For example, the magnets 10 may be mounted utilizing a snap-in method with a series of insertion holes, not shown, disposed along the drum 6. The holes would accommodate insertion members, not shown, affixed to the backs of the magnets 10. This would allow the user to vary the size and shape, as well as position, of each magnet 10. The magnets 10 may also click into contoured reception recesses, not shown, molded into the exterior of the drum 6. These variations in the magnet 10 sizes and shapes would give the user the opportunity to customize the device 100.

Figure 3:
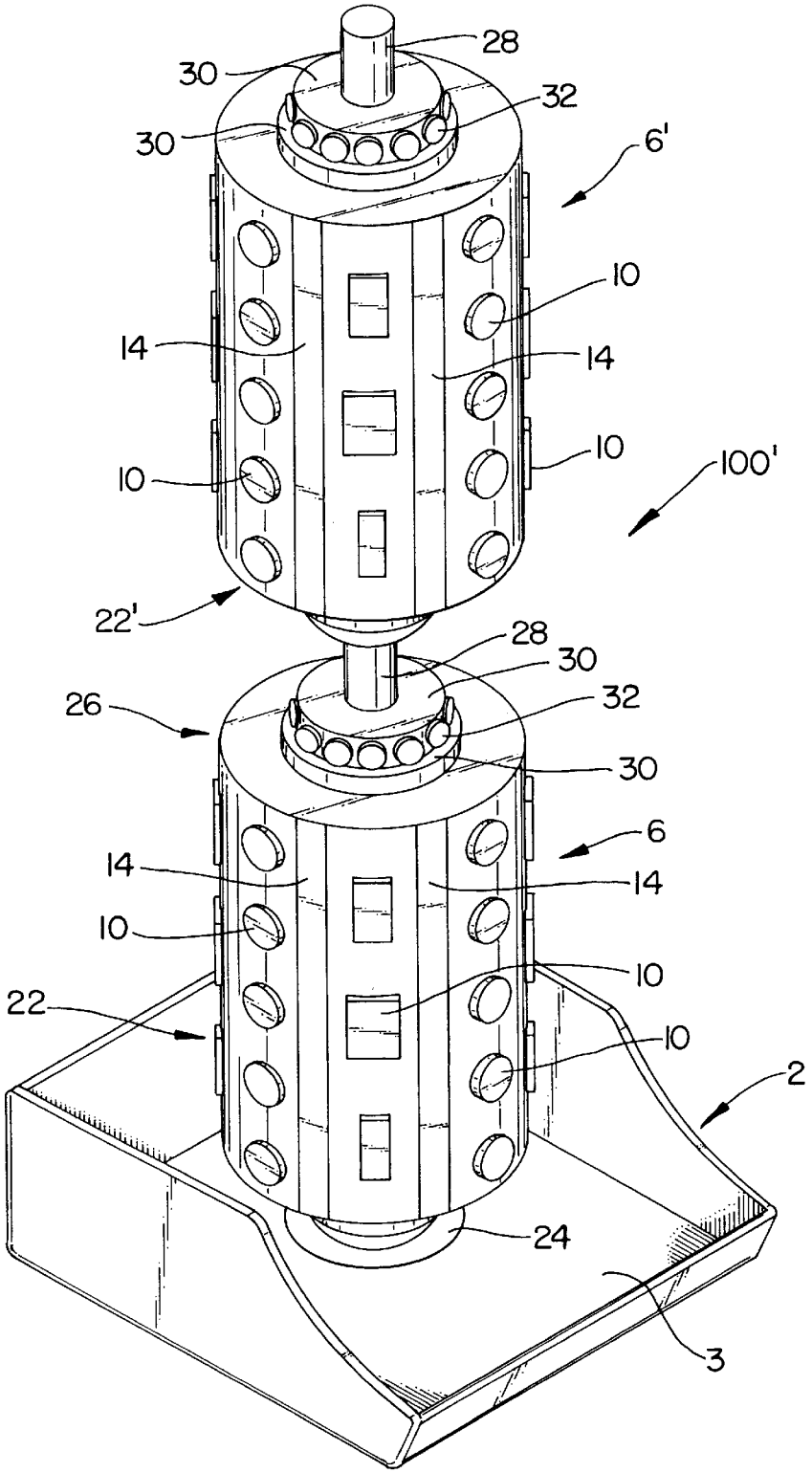
FIG. 3 is a side elevation of an alternate embodiment of the storage device of the present invention.

Although the major axis of the drum 6 is essentially horizontal in the preferred embodiment, the drum may also be oriented vertically. As shown in FIG. 3, a first end 22 of the drum 6 may be placed onto a rotatable base plate 24 to the rotation of the drum about a vertical axis. Additionally, the second end 26 of the drum 6 may include an coupling post 28 onto which the first end 22' of an adjacent drum 6' may be placed. Washers 30 and bearings 32 disposed between the drums 6,6' would permit the drums 6,6' to rotate independently, if desired. In this manner, the drums 6,6' would rotate much like a lazy susan. When oriented vertically, the drums 6,6' may be cone shaped, if desired, to lessen gravity-induced sliding forces acting on attached items.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A holding device for magnetizable items comprising:

a first and second upstanding support member, said support members being spaced apart by a floor member connected therebetween;

a receiving drum rotatably mounted between said support members; and a plurality of laterally and longitudinally spaced apart magnets positioned along the exterior of said drum, said magnets providing discrete areas that contain sufficient magnetic flux density to retain components susceptible to magnetic attraction.

2. The holding device of claim 1, wherein:

said support members have at least one mounting flange extending therefrom; and said drum includes at least one threaded knob that adjustably engages a corresponding mounting flange, said knob being coaxially aligned with an axis of rotation of said drum, said knob being constructed and arranged to adjust relative friction between said drum and said support member.

3. A holding device for magnetizable items comprising:

a first and second vertically-disposed support member, said support members being spaced apart by a floor member connected therebetween;

a horizontally-disposed receiving drum rotatably mounted between said support members;

a plurality of laterally and longitudinally spaced apart magnets positioned along the exterior of said drum, for holding of items thereto, said plurality of magnets providing a plurality of discrete areas that contain sufficient magnetic flux density to retain components susceptible to magnetic attraction; and labeling means disposed along said drum, said labeling means being constructed and arranged to identify each of said spaced apart magnets.

4. The holding device of claim 3, wherein said support member extends from a floor panel.

5. The holding device of claim 4, wherein said floor panel includes at least one upstanding wall extending therefrom.

6. The holding device of claim 3, wherein said labeling means includes indicia-receiving adhesive disposed along said drum.

7. The holding device of claim 3, wherein said labeling means includes a chalkboard member disposed along said drum.

8. The holding device of claim 3, wherein said labeling means includes at least one sheet of paper disposed along said drum.

9. The holding device of claim 8, wherein said at least one sheet of paper includes indexing indica.

* * * * *